US006125190A

United States Patent [19]

Wen

[11] Patent Number: 6,125,190

[45] Date of Patent: Sep. 26, 2000

[54] IMAGE DISPLAY AND AUDIO DEVICE

[75] Inventor: Xin Wen, Rochester, N.Y.

[73] Assignee: Eastman Kodak Company, Rochester, N.Y.

[21] Appl. No.: 08/986,950

[22] Filed: Dec. 8, 1997

[51] Int. Cl.[7] ..... A47G 1/06; G09F 1/00

[52] U.S. Cl. ..... 381/124; 40/124.03; 40/454; 40/717; 40/906; 704/272

[58] Field of Search ..... 369/31, 33, 30; 396/429; 40/454, 455, 456, 906, 124.03, 717, 457; 434/308, 309; 381/28, 124, 56, 61; 704/272

[56] References Cited

U.S. PATENT DOCUMENTS

| | | | |
|---|---|---|---|
| 4,541,188 | 9/1985 | Sadorus | 40/906 |
| 4,636,881 | 1/1987 | Brefka et al. | 369/31 |
| 4,809,246 | 2/1989 | Jeng | 40/906 |
| 5,007,707 | 4/1991 | Bertagni | 350/118 |
| 5,276,478 | 1/1994 | Morton | 355/22 |
| 5,359,374 | 10/1994 | Schwartz | 40/152.1 |
| 5,489,812 | 2/1996 | Furuhata et al. | 310/309 |
| 5,499,465 | 3/1996 | Manico | 40/455 |
| 5,504,836 | 4/1996 | Loudermilk | 395/2.81 |
| 5,574,519 | 11/1996 | Manico et al. . | |
| 5,639,580 | 6/1997 | Morton . | |
| 5,794,371 | 8/1998 | Camillery | 40/717 |
| 5,841,878 | 11/1998 | Arnold et al. | 381/124 |
| 5,878,292 | 3/1999 | Bell et al. | 40/455 |
| 5,914,707 | 6/1999 | Kono | 345/173 |

OTHER PUBLICATIONS

"Invasion of the Microm" by Hank Hogan, New Scientist Jun. 29, 1996, pp. 28–33.

*Primary Examiner*—Forester W. Isen
*Assistant Examiner*—Xu Mei
*Attorney, Agent, or Firm*—Raymond L. Owens

[57] ABSTRACT

A image display and audio device includes a display image and a sensor coupled to the display image for producing an output signal which varies according to the acceleration or orientation of the display image; and an audio producing structure which responds to the output signal generated by the sensor which corresponds to visual information produced on the display image.

13 Claims, 2 Drawing Sheets

IMAGE DISPLAY AND AUDIO DEVICE

FIELD OF THE INVENTION

The present invention is related to the electronic devices for displaying images and playing audio information.

BACKGROUND OF THE INVENTION

When an image is displayed, it is very desirable to vividly reproduce the environment of the original scene of the display image. Information related to the original scene of the display image can include the movement of objects in the original scene, the depths of three dimensional objects in the original scene, and the sound such as voice or music in or related to the original scene.

The depth and motion images can be displayed by a lenticular image that is viewed through a transparent lens sheet that carried a plurality of lenticular lenses. The lenticular image comprises a plurality of composite images of the original scene. For the case of the motion image, the composite images are recorded in a temperal sequence of the original scene. For the case of the depth image, the composite images are captured at different directions of the original scene. Details about the method and apparatus of the lenticular images and lenticular lenses are disclosed in commonly owned U.S. Pat. Nos. 5,276,478 and 5,639,580.

Commonly assigned U.S. Pat. No. 5,574,519 discloses a display apparatus that can display still images and play back audio information.

SUMMARY OF THE INVENTION

It is an object of the present invention to provide an image display device that produces motion or depth perception and is capable of playing audio information according to the sequence of the displayed motion or depth images.

It is another object of the present invention to play such audio information according to the acceleration and/or the orientation of the image display device.

These objects are achieved by a display image and audio device, comprising:

a) a display image;

b) sensor means coupled to the display image for producing an output signal which varies according to the acceleration or orientation of the display image; and c) audio means for producing audio information in response to the output signal generated by the sensor means which corresponds to visual information produced on the display image.

ADVANTAGES

A feature of the present invention is that the audio information can be played corresponding to the sequence of the displayed motion or depth images so that the sound and the image from the original scene can be reproduced simultaneously.

Another feature of the present invention is that the audio information can be stored and played for both audio and still images according to the acceleration and/or the orientation of the image display device.

DETAILED DESCRIPTION OF THE INVENTION

Figure 1:
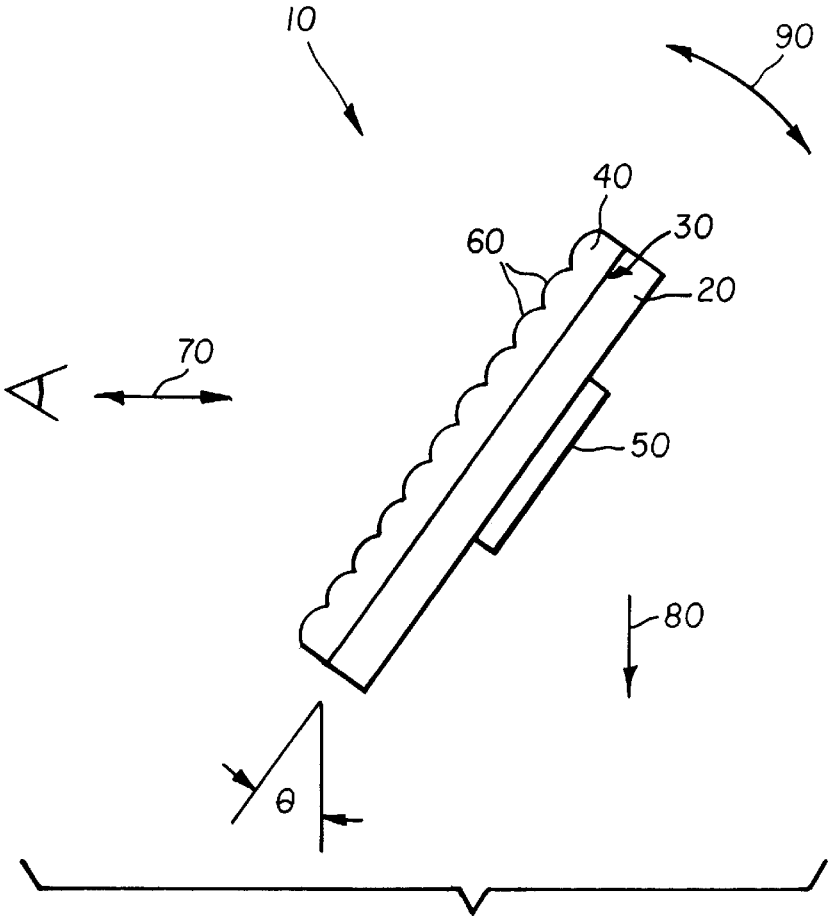
FIG. 1 is a schematic cross section of a imaging and audio device in accordance with the present invention.

An image display and audio device 10 is shown in accordance with the present invention in FIG. 1. The image display and audio device 10 is shown to comprise a substrate 20, a display image 30 comprising a plurality of color pixels formed by colorant such as dyes or inks, an integral lens sheet 40 bonded to the front surface of the substrate 20 and an electronic system 50 attached to the back surface of the substrate 20.

The display image 30 can be either reflective or transmissive. For the case of the transmissive display, the electronic system 50 can be attached to an edge of the substrate 20 so that the light illumination to the back surface of the substrate is not blocked. The display image comprises a plurality of composite images of the original scene. The display image can be a motion image or a depth image. The composite images can be a temperal sequence of the original scene, or a sequence of images captured at different directions of the original scene. The integral lens sheet 40 comprises opposed front and back surfaces, the front surface comprising convex surfaces of a plurality of lens element and the back surface being attached to the front surface of the substrate 20. The display image 30 can be formed on the front surface of the substrate 20, or on the back surface of the integral lens sheet 40. The plurality of convex lens 60 permits a user to view a different image in the composite images in the display image 30 at each viewing direction 70. The methods and apparatus of for producing lenticular display images and lenticular lenses are disclosed in commonly owned U.S. Pat. Nos. 5,276,478 and 5,639,580.

As described below, in the electronic system 50, the sensor system 180 detects the orientation or the acceleration and the audio system 190 plays the audio information. The orientation of the display image 30 is defined by the angle (between the plane of the display image 30 and the gravity direction 80 (that is indicated by a downward arrow). The image viewed among the composite images in the display image 30 is determined by the viewing direction 70 relative to the orientation of the display image 30 as defined by the angle. (The image display and audio device 10 can be accelerated or rotated in many possible directions. One such rotation direction is shown in FIG. 1 as the rotation direction 90.

Figure 2:
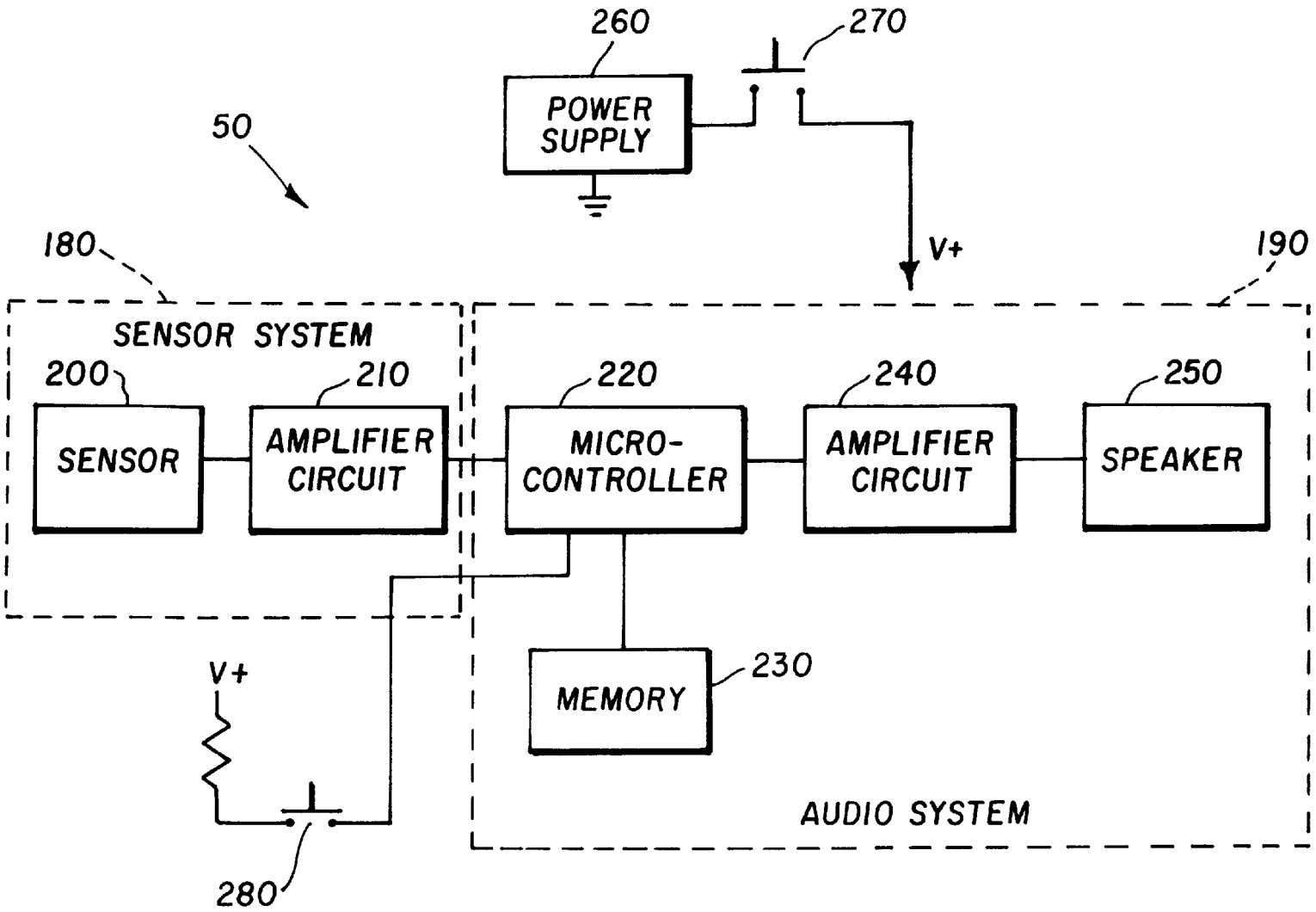
FIG. 2 is a block diagram for the electronic system for detecting the orientation or the acceleration of the display image and playing audio information in the imaging and audio device in FIG. 1.

FIG. 2 shows a block diagram for the electronic system 50 that detects the orientation or the acceleration of the display image 30, and plays audio information. The electronic system 50 comprises a sensor system 180, an audio system 190. The sensor system includes a sensor 200 and an amplifier circuit 210 that includes processing and amplifying circuits and an A/D converter. The audio system 190 has a microcontroller 220, an electronic memory 230, an amplifier circuit 240, and a speaker 250. A power supply 260 such as batteries or a solar cell provide power to the sensor system 180 and the audio system 190. The power to the electronic system 50 is turned on by a switch 270. The electronic system 50 further comprises a start switch 280 for the user to input an electric signal to the microcontroller 220 when the display image 30 is at a particular orientation. Details about the usage of the start switch 280 are described below.

Figure 3:
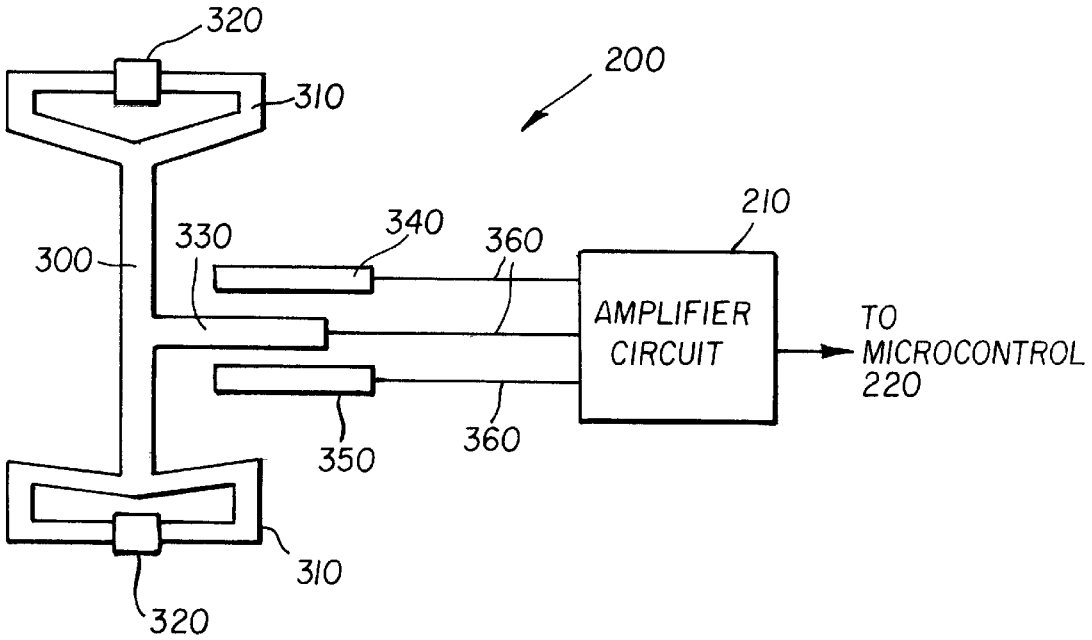
FIG. 3 is an example of the sensor for detecting the orientation or the acceleration of the display image in FIG. 1.

The sensor 200 can detect the forces produced by acceleration. The forces that can be produced by acceleration can include linear acceleration, rotation, gravitation and so on. One example of an acceleration sensor is a MicroElectro-Mechanical System (MEMS) as shown in FIG. 3. The sensor as shown in FIG. 3 includes a microbeam 300 that has two tethers 310 at each end. Each of the two tethers 310 is fixed to an anchor 320. The microbeam 300 has a center plate 330 that is inserted between two parallel outer plates 340. The center plate 330 and the outer plates 340 are properly coated with conductive materials. The capacitance between the center plate 330 and the each of the outer plates 340 and 350 can be measured by an amplifier circuit 210 through electric leads 360.

When the microbeam 300 experiences an acceleration force, which can be caused by linear or centrifugal acceleration or gravity, the microbeam 300 is biased toward one anchor 320 and away the other anchor 320. One tether 310 will be compressed and the other tether 310 will be stretched. The center plate 330 deviates away from the center position, creating a difference in the distances between the center plate 330 from the two outer plates 310. The asymmetric position of the center plate 330 produces a difference in the capacitance between the center plate 330 and outer plate 340 and the capacitance between the center plate 330 and the outer plate 350. The difference in the capacitance generates an electric signal in the amplifier circuit 210. The electric signal is amplified in the amplifier circuit 210, converted to digital signals by an A/D converter, and output to microcontroller 220.

One advantage of using a MEMS for sensor 200 is that MEMS devices can be made very small dimensions, which permits the image display and audio device 10 to be made compact in space. The above example of the acceleration sensor is only one of the many possible MEMS designs that can be used in the present invention. An introduction to MEMS device is described in p28, June 1996, New Scientist.

Referring back to FIG. 2, a memory 230 stores audio information. Typically, the audio information is related to the image content of the display image 30. The audio information can be recorded at the original scene or created and stored at different times. The memory 230 can be a nonvolatile electronic memory such as an Erasable Programmable Read-Only-Memory (EPROM). It is noticed that audio system 190 can be integrated in one audio IC memory chip. One example of such a chip is the ISD 2500 manufactured by Information Storage Systems, Inc. The audio information can also be input from a memory card such as a PCMCIA card, a magnetic disk, a compact disk, or a digital camera.

When the microcontroller 220 receives an electric signal from the amplifier circuit 210 indicating an acceleration force, the microcontroller 220 can then send electric signals to amplifier circuit 240 according to the audio information stored in memory 230. The amplifier circuit 240 properly processes and amplifies the electric signal, and convert the digital signal to analog signal, which is then sent to drive a speaker 250. The speaker 250 then plays the audio information.

An example of the operation of the image display and audio device 10 is now described. Referring to FIG. 1, an image display and audio device 10 is held in a user's hand. The display image 30 is viewed by a user in the viewing direction 70. The image viewed among the composite of images in the display image 30 is determined by the viewing direction 70 relative to the orientation of the display image 30 as defined by the angle. (When the image display and audio device 10 is rotated along the rotation direction 90 to the start of the sequence of the composite images, the user sends an electric signal by switching on the start switch 280. The microcontroller 220 receives the electric signal and starts the playing of the audio information as described above. As the user continuously rotates the image display and audio device 10, different images in the composite images of the display image 30 came into the view of the user. The sensor continuously sends electric signals to update the microcontroller 220 the current orientation of the image display and audio device 10. The audio information is played in such a way that corresponds to the image content at each particular orientation. The simultaneous replay of the sound information and display of motion or depth information from the original scene vividly reproduce the original scene, which is highly desirable to the customers.

Another example of the operation of the image display and audio device 10 is now described. For the image display and audio device 10, as shown in FIG. 1, the audio information is played simply when the image display and audio device 10 experiences an acceleration force such as the one produced by rotation along rotation direction 90. As described above, when an acceleration force above a threshold is detected by the sensor 200, the signal is amplified by amplifier circuit 210 and sent to the microcontroller 220. The microcontroller then sends electric signal according to the audio information stored in memory 230, for the speak 250 to play. During the play of the audio information, the user can continually rotate and view the sequence of motion or depth images in the display image 30. Note that this particular operation of the image display and audio device 10 is also applicable to a display device comprising a still image.

The invention has been described in detail with particular reference to certain preferred embodiments thereof, but it will be understood that variations and modifications can be effected within the spirit and scope of the invention.

What is claimed is:

1. An image display in which the direction of a viewer changes the image seen by the viewer and an audio device, comprising:

a) a plurality of fixed display images to be viewed, the viewed image depending on the viewing direction of the viewer relative to the orientation of display image;

b) an integral lens sheet with opposed front and back surfaces, the front surface comprising convex surfaces of a plurality of lens element and the back surface being attached to the display image so that the viewer views different images depending on the viewing direction; and c) means responsive to the viewing direction relative to the display image for producing audio information which corresponds to viewed images on the display image.

2. The image display and audio device of claim 1 wherein the display image produces a reflective image.

3. The image display and audio device of claim 1 wherein the display image produces a transmissive image.

4. The image display and audio device of claim 1 wherein the plurality of images provide a perception of motion when viewed at different viewing directions.

5. An image display in which the direction of a viewer changes the image seen by the viewer and an audio device, comprising:

a) a plurality fixed display images to be viewed, the viewed image depending on the viewing direction of the viewer relative to the orientation of display image;

b) an integral lens sheet with opposed front and back surfaces, the front surface comprising convex surfaces of a plurality of lens element and the back surface being attached to the display image;

c) a MicroElectroMechanical System coupled to the display image and having a sensor for producing an output signal which varies according to the acceleration or orientation of the display image; and d) audio means for producing audio information in response to the output signal generated by the sensor which corresponds to a particular visual image produced on the display image corresponding to the viewing direction.

6. The image display and audio device of claim 5 further comprising a first amplifier circuit for amplifying and processing the signal from the sensor and applying such amplified signal to the microcontroller.

7. The image display and audio device of claim 5 wherein the audio means includes a microcontroller and an electronic memory for storing audio information that can be played during the viewing of the displayed image and wherein the microcontroller selects the appropriate audio information to be played.

8. The image display and audio device of claim 7 wherein the audio means further includes a speaker and a second amplifier circuit for amplifying and processing an audio-information signal for the speaker.

9. The image display and audio device of claim 5 filer including a power supply for providing power to the sensor and the audio means.

10. The image display and audio device of claim 5 wherein the display image produces a reflective image.

11. The image display and audio device of claim 5 wherein the display image produces a transmissive image.

12. The image display and audio device of claim 5 wherein the plurality of images provide a perception of motion when viewed at different viewing directions.

13. The image display and audio device of claim 5 wherein the plurality of images provide a perception of depth when viewed at different viewing directions.

* * * * *